US006165951A

United States Patent [19]

Leonhardt

[11] Patent Number: 6,165,951

[45] Date of Patent: Dec. 26, 2000

[54] LUBRICATING COMPOSITION

[75] Inventor: Helmut Leonhardt, Hamburg, Germany

[73] Assignee: Shell Oil Company, Houston, Tex.

[21] Appl. No.: 09/265,939

[22] Filed: Mar. 10, 1999

[30] Foreign Application Priority Data

Feb. 27, 1998 [EP] European Pat. Off. ..... 98103492

[51] Int. Cl.[7] ..... C10M 141/06; C10M 141/08; C10M 141/10

[52] U.S. Cl. ..... 508/437; 508/438; 508/439; 508/443; 508/464

[58] Field of Search ..... 508/437, 438, 508/439, 443, 463, 464, 506

[56] References Cited

U.S. PATENT DOCUMENTS

| | | | |
|---|---|---|---|
| 4,867,890 | 9/1989 | Colclough et al. | 252/327 |
| 5,520,830 | 5/1996 | Klaus et al. | 252/49.7 |
| 5,605,880 | 2/1997 | Arai et al. | 508/379 |

FOREIGN PATENT DOCUMENTS

| | | | |
|---|---|---|---|
| 0 519 760 A1 | 12/1992 | European Pat. Off. | C10M 141/10 |
| 0 696 636 A1 | 2/1996 | European Pat. Off. | C10M 171/00 |
| 1 594 405 B | 5/1970 | Germany | C10M 1/48 |
| 990 097 | 4/1965 | United Kingdom . | |
| 1 205 177 | 9/1970 | United Kingdom | C10M 3/42 |
| 1 440 129 | 6/1976 | United Kingdom | C10M 3/20 |

OTHER PUBLICATIONS

Search Report dated May 31, 1999.

*Primary Examiner*—Margaret Medley
*Attorney, Agent, or Firm*—Kim Muller

[57] ABSTRACT

The present invention relates to a lubricating composition comprising a hydrocarbon lubricant base oil in combination with (a) a phenyl-naphthylamine, (b) a thiophosphate, and (c) a diphenyl amine, preferably in combination with (d) an aspartic acid ester. Further, the invention relates to the use of the lubricating composition for lubricating a combination of a gas turbine and a steam turbine.

5 Claims, No Drawings

LUBRICATING COMPOSITION

FIELD OF THE INVENTION

The present invention relates to lubricating compositions, more specifically to lubricating compositions for lubricating a combination of a steam turbine and a gas turbine.

BACKGROUND OF THE INVENTION

The use of a combination of a gas turbine and a steam turbine for power generation, has the advantage that it is more efficient than power generation with either type of turbine. The combination will hereinafter also be referred to as "combined cycle". A difficulty of lubricating a combined cycle resides in the large variety of different components which must be lubricated, i.e. bearings (both journal and thrust), gears, hydraulic control systems, flexible couplings and oil shaft seals. Although each component could be lubricated per se, it is advantageous to have a single, common lubricating system containing a single, common lubricant for all components.

The lubricating composition for use in the common system will have to meet a rather outstanding combination of requirements in order to satisfactorily lubricate each component. These requirements comprise the rather severe thermal and oxidative stability requirements and stringent foaming levels for the gas turbine part, whereas the steam turbine part requires the oil to have good water shedding properties and excellent corrosion resistance. High temperature oxidative stability means that the lubricating composition has a low tendency to form sludge, a low increase in viscosity and a low increase in total acid number at high temperature. Desirable characteristics are a viscosity increase of at most 20%, a total acid number increase of at most 3.0 mg KOH/g and a sludge content of less than 300 mg/100 ml after having been subjected to the oxidation stability test DIN 51394 performed according to the high temperature modifications set out in the General Electric specifications GEK 32568 C and GEK 101941, preferably less than 250 ml/g, more preferably less than 200 ml/g, most preferably less than 150 ml/g. In establishing the amount of sludge produced, the sludge must be removed carefully from all the equipment used in the test. The sludge is separated from the oil by filtration.

It has been found that especially the tendency of the lubricating composition to form sludge, is important in whether a lubricating composition is suitable for use in lubricating combined cycle equipment.

The lubricating composition for use in combined cycle must further have a certain viscosity index, pour point, filterability and anti-wear performance, while the composition should provide adequate lubrication over many years.

Achieving this combination of complex lubricant properties allows the lubricating oil to be suitable for use in a combined cycle.

In EP-A-696 636 it is taught to use a combination of (A) a lubricating base oil, (B) an alkyl diphenylamine and/or phenyl-α-naphthylamine and (C) oxymolybdenum sulfide dithiocarbamate and/or oxymolybdenum sulfide organophosphorodithioate. One kind of alkyldiphenylamine may be used alone, or two or more kinds of alkyldiphenylamine may be used together. One kind of phenyl-α-naphthylamine may be used alone or two or more kinds of phenyl-α-naphthylamine may be used together. Also one or more kinds of alkyldiphenylamine and one or more kinds of phenyl-α-naphthylamine may be used together. In the examples, either a single alkyl diphenylamine or a single phenyl-α-naphthylamine is used. Oxymolybdenum sulfide organophosphorodithioate is present in only one of the examples according to the teaching. EP-A-696 636 does not disclose or teach to use the specific combination of alkyl diphenylamine and phenyl-α-naphthylamine and thiophosphate.

Further, it is known to use a combination of amine antioxidants, optionally in combination with a thiophosphate, in ester base oils for use in gas turbine engines for aviation purposes. Such formulations have been described in GB-B-990,097, GB-A-2272000 and GB-B-1,293,245. These documents do not disclose or teach to use a combination of a diphenylamine, thiophosphate and phenyl-α-naphthylamine in a hydrocarbon lubricant base oil.

DESCRIPTION OF THE INVENTION

A lubricating composition has now been found which meets the requirements for use in a combined cycle. Furthermore, this lubricating composition shows an especially low tendency to form sludge at high temperatures.

The lubricating composition according to the invention comprises a hydrocarbon lubricant base oil in combination with (a) a phenyl-naphthylamine, (b) a thiophosphate and (c) a diphenyl amine.

The lubricating composition according to the present invention can comprise a single compound or a mixture of compounds for each of components (a), (b), (c) and (d).

The phenyl-naphthylamine which is used in the present invention, can be either substituted or non-substituted, or a mixture of both. The phenyl-naphthylamine can be used as such or in the form of a salt. A preferred substituted phenyl-naphthylamine is a mono-alkylated phenyl-alpha-naphthylamine. A further preferred penyl-alpha-naphthylamine is a monooctylated phenyl alpha-naphthylamine.

The phenyl-naphthylamine preferably is a phenyl-alpha-naphthylamine.

It is preferred that the phenyl-naphthylamine is a non-substituted phenyl-alpha-naphthylamine. Phenyl-naphthylamines as commercially available can be used in the present invention.

The lubricating composition according to the present invention further comprises a diphenylamine. The diphenylamine can be substituted or non-substituted. It is preferred to use a hydrocarbyl substituted diphenylamine, more preferably an alkyl substituted diphenyl amine. A preferred diphenyl amine is 4,4'-dialkyl diphenyl amine. The alkyl group preferably contains between 2 and 15 carbon atoms, preferably between 5 and 12. A preferred diphenyl amine is dioctyl diphenylamine.

The thiophosphate compound can be a thiophosphoric acid, a substituted thiophosphoric acid, a salt of a thiophosphoric acid, and/or a salt of a substituted thiophosphoric acid. Preferably, the thiophosphate is substituted by one or more hydrocarbyl groups which hydrocarbyl group can optionally contain an acid, a hydroxy and/or an ester group. The hydrocarbyl moiety preferably is an alkyl containing up to 12 carbon atoms. The hydrocarbyl substituted thiophosphate preferably contains 2 or 3 hydrocarbyl groups, or is a mixture of thiosphosphates containing 2 and 3 hydrocarbyl groups.

The thiophosphate can contain any number of sulphur atoms directly linked to the phosphor atom. Preferably, the thiophosphate is a monothiophosphate and/or a dithiophosphate.

Either the thiophosphate acid or its salt can be used in the present invention. Preferably, a salt of the thiophosphate is used. More preferably, an amine salt of the thiosphosphate is used. Further preferred thiophosphates and ways to prepare them, have been described in EP-A-375324. A suitable thiosphosphates which is commercially available is LZ 5125 from Lubrizol Corporation.

The hydrocarbon lubricant base oil present in the lubricating composition of the present invention can be any hydrocarbon oil suitable for use in a lubricant. Different suitable base fluids can have different lubricating viscosity. The hydrocarbon base oil essentially consists of compounds which only contain hydrogen and carbon. A limited amount of contaminants such as sulphur containing compounds can be present. Preferably, more than 80% wt of the base oil consists of compounds consisting of hydrogen and carbon only, more preferably more than 90% wt. The base oil can be a natural or a synthetic lubricating oil, or mixtures thereof. The natural oil can be a mineral oil such as liquid petroleum oils and solvent treated or acid treated mineral lubricating oils of the paraffinic, naphthenic, or mixed paraffinic/naphthenic type which may be further refined by hydrocracking and hydrofinishing processes and/or dewaxing. Synthetic lubricating oils include hydrocarbon oils such as polymerized and interpolymerized olefins. Preferably, the base oil is a mineral oil which contains less than 10% by weight of aromatic compounds, preferably less than 5% by weight, most preferably less than 3.0% by weight, measured according to DIN 51378. It is further preferred that the base oil contains less than 1.0% by weight of sulphur, calculated as elemental sulphur, preferably less than 0.1% by weight, more preferably less than 0.05% by weight, measured according to ASTMD 4045. Such mineral oils can be obtained by severe hydroprocessing. Preferably, the lubricant base oil has a kinematic viscosity in the range of from 5 to 220 cSt at 40° C., more preferably of from 10 to 200 cSt, most preferably of from 20 to 100 cSt.

Preferably, the composition according to the present invention contains no sulfurized fatty acid. The amount of sulfurized fatty acid preferably is less than 0.5% by weight, based on total amount of lubricating composition, more preferably less than 0.1% by weight, most preferably less than 0.02% by weight, based on total amount of composition.

Optionally, the lubricating composition according to the invention comprises a further component (d) which is a compound according to the following formula I (formula I)

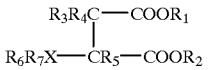

in which $R_1$ and $R_2$ are each hydrogen or alkyl or hydroxyalkyl of 1 to 30 carbon atoms; $R_3$, $R_4$ and $R_5$ are each hydrogen or alkyl of 1 to 4 carbon atoms, X is CH or N and $R_6$ and $R_7$ are each hydrogen, alkyl or alkenyl of 1 to 30 carbon atoms, or an acyl group derived from a saturated or unsaturated carboxylic acid of up to 30 carbon atoms. Preferably, $R_1$ and $R_2$ are each alkyl of 3 to 6 carbon atoms, $R_3$, $R_4$ and $R_5$ are each hydrogen, X is N and $R_6$ and $R_7$ are each alkyl or 15 to 20 carbon atoms or an acyl radical derived from a saturated or unsaturated dicarboxylic acid containing 4 to 10 carbon atoms, at least one of $R_6$ and $R_7$ being an acyl group. Especially preferred is aspartic acid N-(3-carboxy-1-oxo-2-propenyl)N-octadecyl-bis(2-methylpropyl)ester. Such aspartic acid esters are commercially available.

It is preferred that the lubricating composition according to the invention contains no substantial amount of phenolic antioxidant. It has been found that the use of phenolic antioxidants, more specifically alkylated phenols such as 2,6-di-tert.butyl-phenol and 4,4' (methylenebis(2,6-di-tert.butyl-phenol)), gives increased sludge formation at high temperature. Furthermore, it is known that low molecular weight phenolic antioxidants tend to vaporize. This leads to malfunction of the remainder of the lubricating composition. The amount of phenolic antioxidant present preferably is less than 1% by weight, more preferably less than 0.5% by weight, most preferably less than 0.1% by weight, based on total amount of composition.

The lubricating composition can further comprise conventional additives. It is preferred that the composition further contains a metal passivator, a rust inhibitor, a foam inhibitor and/or a demulsifier. Component (d) is the preferred rust inhibitor.

The amount of the additives to be present in the lubricating composition, depends on the specific compounds used.

Generally, the lubricating composition preferably contains between 0.1 and 5.0% by weight, preferably more than 0.2% and preferably less than 2.0% of phenylnaphthylamine, between 0.01 and 1.0% by weight, preferably more than 0.02% and preferably less than 0.5%, of thiophosphate and between 0.1 and 5.0% by weight, preferably more than 0.2% and preferably less than 2.0%, of diphenyl amine, between 0 and 1.5% by weight, preferably between 0 and 1.0% by weight of a compound according to formula I; and at least 95% by weight of base oil, preferably mineral oil, all based on total amount of the composition.

The present invention further relates to the use of the lubricating composition according to the invention for lubricating a combination of a gas turbine and a steam turbine, more preferably such combination utilising a pressurised-steam generator. Further, the invention relates to lubrication of a combination of a gas turbine and a steam turbine utilising a pressurised-steam generator.

The lubricating composition according to the present invention can be prepared by adding together the phenylnaphthylamine, the thiophosphate, the diphenylamine, the hydrocarbon base oil and optionally the aspartic acid ester.

EXAMPLES

Formulations have been subjected to a test for high temperature oxidation stability known as the oxidation test DIN 51394 performed according to the high temperature modifications set out in the General Electric specifications GEK 32568 C and GEK 101941. In this test, the oil is maintained at 175° C. for 72 hours in the presence of five metal catalysts (copper, steel, aluminium, magnesium, silver) whilst air is bubbled through the oil at a rate of 3 1/hour. At the end of the test, the oil is analysed for its viscosity increase, its increase in total acid number and the total amount of sludge produced. The sludge must be removed carefully from the equipment, especially from the full height of the sides of the cylinder. The sludge is separated by filtration with the help of 5 micron filtration paper available from Millipore, the sludge removed is washed with n-heptane and subsequently dried and weighed.

The formulations contained the following additives.

Aminic antioxidant I: phenyl-alpha-naphthylamine (not substituted)

Aminic antioxidant II: dioctyl diphenyl amine available from Millipore, the sludge removed is washed with n-heptane and subsequently dried and weighed.

The formulations contained the following additives.

Aminic antioxidant I: phenyl-alpha-naphthylamine (not substituted)

Aminic antioxidant II: dioctyl diphenyl amine

Rust inhibitor: aspartic acid N-(3-carboxy-1-oxo-2-propenyl)-N-octadecyl-bis(2-methylpropyl)ester.

Antiwear agent: amine salt of dialkylthiophosphate, LZ®5125 commercially available from Lubrizol.

The additives were added to a base oil containing a solvent extracted and hydrofinished mineral oil containing less than 3% by weight of aromatic compounds (measured by DIN 51378) and less than 0.05% by weight of sulfur compounds (measured by ASTM D 4045), calculated as elemental sulphur, and further containing a conventional metal passivator, foam inhibitor and demulsifier. For compositions 1 and 2, base fluid A was used. For compositions 3–5, base fluid B was used. The fluids differ in the conventional metal passivator present.

The amounts are % by weight on total amount of formulation, including mineral oil.

| | Compositions | | | | |
|---|---|---|---|---|---|
| | 1 | 2 (comparative) | 3 | 4 (comparative) | 5 (comparative) |
| Base fluid | A | A | B | B | B |
| Aminic antioxidant I | 0.5 | 0.5 | 0.5 | 1.0 | — |
| Aminic antioxidant II | 0.5 | 0.5 | 0.5 | — | 1.0 |
| Antiwear agent | 0.1 | — | 0.1 | 0.1 | 0.1 |
| Rust inhibitor | 0.1 | 0.1 | 0.1 | 0.1 | 0.1 |
| sludge formation (mg/100 ml) | 190 | 360 | 144 | 234 | 352 |

What is claimed is:

1. A lubricating composition comprising a hydrocarbon lubricant base oil in combination with:

(a) a phenyl-naphthylamine, (b) a thiophosphate, (c) a diphenyl amine, and (d) aspartic acid N-(3-carboxy-1-oxo-2-propenyl)-N-octadecyl-bis(2-methylpropenyl) ester (formula I)

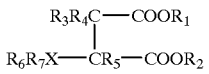

in which $R_1$ and $R_2$ are each hydrogen or alkyl or hdyroxyalkyl of 1 to 30 carbon atoms; $R_3$, $R_4$ and $R_5$ are each hydrogen or alkyl or hdyroxyalkyl of 1 to 4 carbon atoms; X is CH or N; and $R_6$ and $R_7$ are each hydrogen, alkyl or alkenyl of 1 to 30 carbon atoms, or an acyl group derived from a saturated or unsaturated carboxylic acid of up to 30 carbon atoms.

2. The lubricating composition according to claim 1, which composition contains less than 0.02% by weight of sulfurized fatty acid.

3. The lubricating composition according claim 2, which composition contains as base oil a mineral oil containing less than 10% by weight of aromatic compounds and less than 1.0% by weight of sulfur, calculated as elemental sulfur.

4. The lubricating composition according to claim 3, which lubricating composition further comprises a metal passivator, a rust inhibitor, a foam inhibitor and/or a demulsifier.

5. The lubricating composition according to claim 4, which composition contains between 0.1 and 5.0% by weight of phenyl-naphthylamine, between 0.01 and 1.0% by weight of thiophosphate and between 0.1 and 5.0% by weight of diphenyl amine, between 0 and 1.5% by weight of (d) aspartic acid N-(3-carboxy-1-oxo-2-propenyl)-N-octadecyl-bis(2-methylpropenyl) ester, and at least 95% by weight of mineral oil, all based on total amount of the composition.

* * * * *